US005832673A

United States Patent [19]

Cho

[11] Patent Number: 5,832,673

[45] Date of Patent: Nov. 10, 1998

[54] SUMP SEAL AND EXTENDER

[75] Inventor: David S. Cho, Cypress, Calif.

[73] Assignee: Atlantic Richfield Company, Los Angeles, Calif.

[21] Appl. No.: 655,748

[22] Filed: May 30, 1996

[51] Int. Cl.[6] ..... E02D 29/14

[52] U.S. Cl. ..... 52/19; 52/20; 52/3; 220/254; 220/319; 404/25

[58] Field of Search ..... 52/169.6, 3, 19–21, 52/23; 404/24, 26, 25; 405/52; 285/148.22, 148.23, 148.26, 124.3; 220/202, 254, 315, 319, 367.1; 137/363

[56] References Cited

U.S. PATENT DOCUMENTS

| | | | |
|---|---|---|---|
| 4,061,434 | 12/1977 | Carrol | 52/21 |
| 4,085,257 | 4/1978 | Smith | 141/86 |
| 4,842,443 | 6/1989 | Argandona | 404/25 X |
| 5,076,456 | 12/1991 | Geyer | 220/4.26 |
| 5,257,652 | 11/1993 | Lawrence | 137/363 X |
| 5,333,490 | 8/1994 | Webb | 137/363 X |
| 5,360,131 | 11/1994 | Phillips et al. | 220/8 |
| 5,490,419 | 2/1996 | Webb | 137/363 X |

*Primary Examiner*—Robert Canfield
*Attorney, Agent, or Firm*—David L. McCombs; Randall E. Colson

[57] ABSTRACT

A seal and extender assembly which prevents surface water and other environmental liquids from inadvertently entering a sump, such as one used in a gasoline service station. The seal assembly includes an extender and a cover. The extender defines a channel and has a first end and a second end, the first end has a larger diameter than the diameter of the second end, the first end is secured to the sump adjacent the access port. The cover has a top surface and a perimeter surface, the top surface covers the access port and the perimeter surface secures to the second end of the extender.

31 Claims, 3 Drawing Sheets

SUMP SEAL AND EXTENDER

BACKGROUND OF THE INVENTION

The present invention relates to a sump seal and extender and, more particularly, to such a seal and extender for use with in-ground sumps to prevent inadvertent surface water incursion.

In-ground sumps are frequently used in the hydrocarbon industry, particularly in gasoline service stations, to capture spilled hydrocarbons and prevent their escape into the surrounding ground. Such sumps are typically used to encase underground pumps which pump gasoline from underground storage tanks to above ground dispensers, as well as to encase filler pipes used to fill the underground storage tanks. A liquid sensor is placed in the sump which may generate an alarm to indicate that liquid has entered the sump and which may automatically shut down the service station until the liquid has been vacuumed from the sump. This design is to prevent gasoline from entering the ground as well as to prevent potentially hazardous operation of the service station when a spill occurs.

In order to prevent false alarms and needless service station downtime, the sumps are designed to prevent surface water and other liquids from inadvertently entering the sump. To this end, the access port of the sump is designed with a smaller diameter than the manway and is normally centered under a manway cover with backfill placed against the sides of the sump. A manway cover having sealing gaskets around its perimeter is placed over the manway to prevent surface water from entering the manway. While the manway cover is normally provided with a seal or gasket which is designed to securely seal access to the manway, thus prohibiting water and other elements from entering the sump, often times the manway cover is not properly installed, or the seal becomes damaged or degrades thus allowing water to flow into the manway. When this occurs, water normally flows down the side of the manway and into the backfill where it is dispersed.

However, during heavy rains or when the sump is either not properly centered under the manhole or its access port is placed below the grade of the backfill, water enters the manhole and may flow directly into the access port or may be deflected by the backfill into the access port. When this occurs, the service station is automatically shut down, causing undesirable and unneeded business interruption.

Therefore, what is needed is a sump seal and extender assembly which prevents surface water and other environmental liquids from inadvertently entering the sump during heavy rains or when the sump is improperly installed relative to the manway.

SUMMARY OF THE INVENTION

The present invention, accordingly, provides a seal and extender assembly which prevents surface water and other environmental liquids from inadvertently entering a sump during heavy rains or when the sump is improperly installed relative to a manway. To this end, a seal assembly comprising an extender and a cover are provided. The extender has a first end and a second end with a channel defined between the two ends. The first end of the extender has a diameter larger than a diameter of its second end, with the first end secured to the sump's access port. The cover has a first set of belt loops proximate its perimeter with a first cinch threaded through the first set of belt loops. A first tightening mechanism secures the cinch and the cover to the second end of the extender. The cover may also have at least one handle secured to the perimeter of the cover and a vent secured to a top surface of the cover. Additionally, the cover may have at least one sleeve for receiving at least one fill pipe and/or overfill container. The sleeve having a second set of belt loops around a perimeter of the sleeve with a second cinch threaded through the second set of belt loops. A second tightening mechanism secures the cinch and the sleeve to the fill pipe or overfill container. The sleeve may also have at least one handle secured to the perimeter of the sleeve.

An advantage achieved with the present invention is that the extender may be installed on a sump even when the access port abuts the wall of the manway or when backfill cannot be removed from around the access port.

Another advantage achieved with the present invention is that since the diameter of the second end is smaller than the diameter of the first end, a channel is formed around the extender to allow water to flow to the backfill.

Another advantage achieved with the present invention is that the cover may be placed on the extender even when the access port abuts the wall of the manway.

Another advantage achieved with the present invention is that the extender and cover may be placed on existing sumps.

DESCRIPTION OF THE PREFERRED EMBODIMENTS

Figure 1:
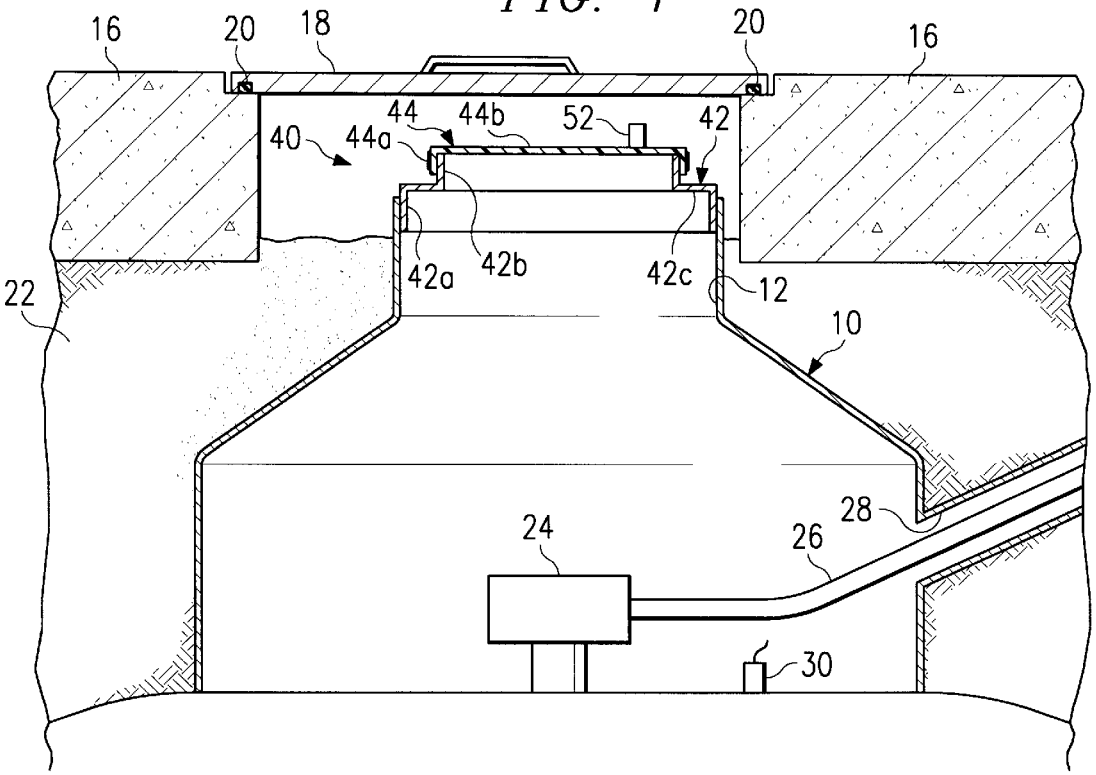
FIG. 1 is a sectional view of a sump incorporating one embodiment of the seal and extender of the present invention.

Referring to FIG. 1, a sump 10 having an access port 12 is located substantially underground with the access port 12 positioned proximate a manway 14 formed in the pavement 16. A removable manway cover 18 having a gasket 20 secured around its perimeter seals the manway 14 to prohibit surface water and other liquids from entering the manway 14. Backfill 22, such as gravel, is placed around the sump 10 to allow for surface water and other liquids that inadvertently enter the manway to drain away from the sump 10.

In the embodiment shown, the sump 10 houses a pump 24 to transport gasoline from an underground storage tank (not shown) located below the sump 10 through a primary pipe 26 to an above ground dispenser such as a conventional gasoline pump (not shown). The sump 10 also includes a conduit 28 which encases the primary pipe 26 to channel any gasoline leaked from the primary pipe 26 into the sump 10. The sump 10 also houses a liquid detector 30 which serves to detect when liquid has accumulated in the sump 10.

Figure 2:
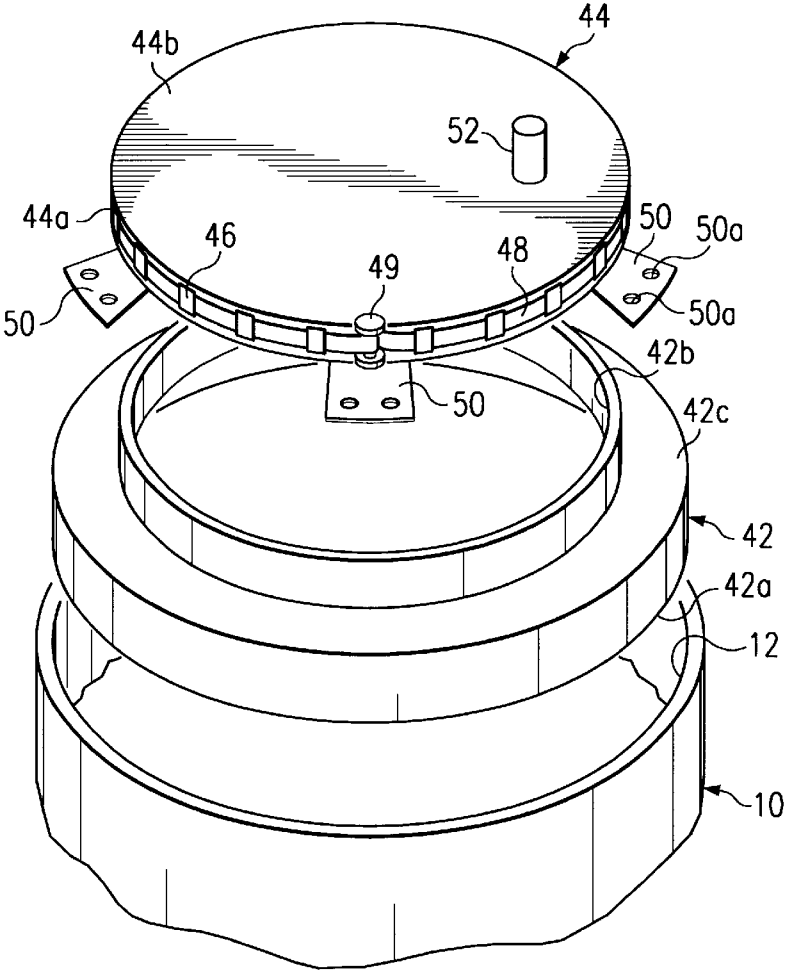
FIG. 2 is an exploded perspective view of the seal and extender embodiment shown in FIG. 1.

Referring now to FIGS. 1 and 2, in accordance with the present invention a seal assembly 40 is shown which includes an extender 42 and a cover 44. The extender 42 is substantially tubular body and has a first end 42*a* and a second end 42*b*. The extender 42 is designed with its first end 42*a* having a diameter larger than a diameter of the second end 42*b*. While the extender 42 is shown with an approximate 90 degree shoulder 42*c* between the first end 42*a* and the second end 42*b*. The extender may be designed in any fashion to provide at lease one diameter of the first end 42*a* that is longer than at least one diameter of the second end 42*b*. Because of the difficulties inherent in installing the extender 42 when the access port 12 is placed too close to the wall of the manway 14 or where the backfill cannot be easily removed from around the perimeter of the access port 12, the extender first end 42*a* is designed to fit inside the access port 12.

The cover 44 is sized to fit over the second end 42*b* of the extender 42 and has a perimeter surface 44*a* and a top surface 44*b*. Belt loops 46 are secured around the perimeter surface 44*a* and a cinch 48 is threaded through the belt loops 46. The cinch 48 may be secured by a rachet buckle 49, or by any other conventional tightening method, to secure the cover 44 to the second end 42*b* of the extender 42. Handles 50 are secured to the perimeter surface 44*a* of the cover 44 and contain finger pulls 50*a*. A vent 52 is secured in the top surface 44*b* of the cover 44.

In operation, the first end 42*a* of the extender 42 is inserted into the access port 12 and is secured to the sump 10 in any conventional fashion to create a watertight seal. Typically, the sump 10 and extender 42 are both manufactured from fiberglass which allows for a watertight bond to be made using appropriate bonding material. Once the extender 42 has been secured to the sump 10, the cover 44 is then secured over the second end 42*b* of the extender 42. Utilizing the handles 50, the cover perimeter surface 44*a* is positioned around the extender second end 42*b*. With the cover 44 in position, the cinch 48 is drawn tight around the extender second end 42*b* and is secured by the racket buckle 49 or in any other conventional fashion. Accordingly, with the extender 42 and cover 44 in place, surface water or other liquids inadvertently flowing into the manway 14 are diverted from entering the sump 10 and will flow to exposed backfill 22, normally by the shoulder 42*c*, for normal drainage. The vent 52 provides ventilation for the sump 10 and is raised from the cover top surface 44*b* to prevent water accumulating on the top surface 44*b* from entering the sump 10. When it becomes necessary to enter the sump 10 through the extender 42, the cover 44 is easily removed by loosening the cinch 48, grasping the handles 50 and lifting the cover 44.

Figure 3:
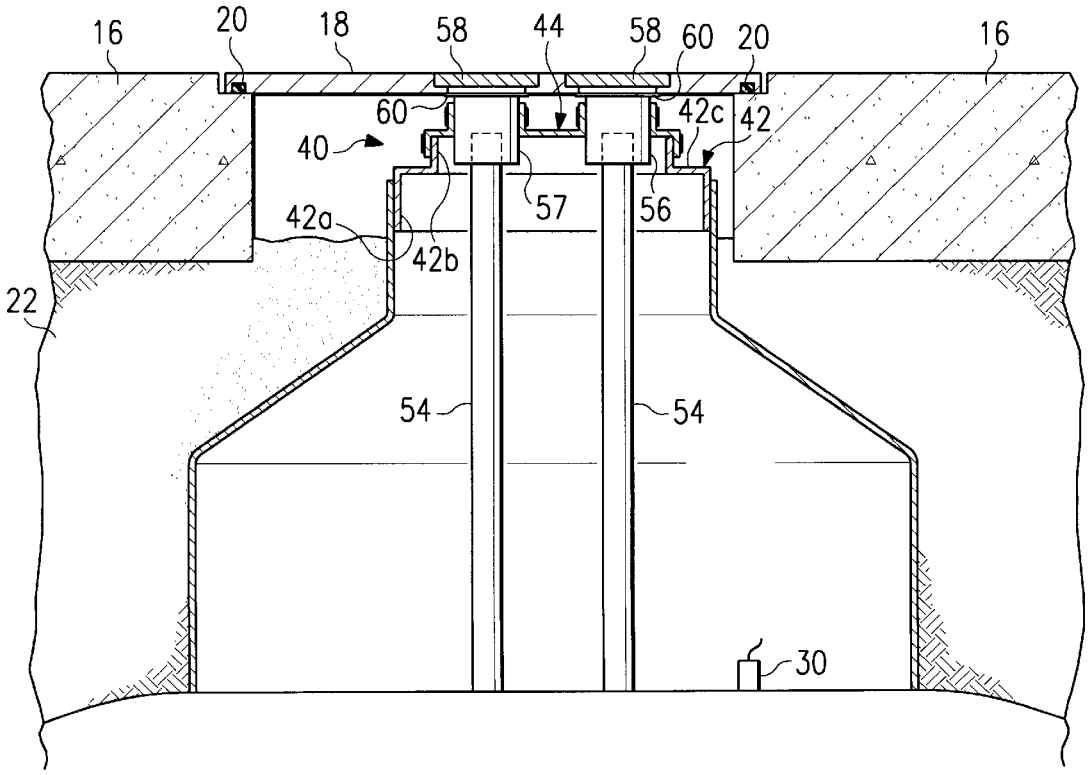
FIG. 3 is a sectional view of a sump incorporating a second embodiment of the seal and extender of the present invention.

Referring now to FIG. 3, an alternative embodiment of the present invention is shown. Since this embodiment contains identical components to the embodiment shown above, identical numbering will be used. In this embodiment the sump 10 encases two fill pipes 54 which are used to fill the underground tank (not shown). Secured around the top of each fill pipe 54 is an overfill container 56, 57, such as a 5 gallon bucket, designed to trap minor spills of gasoline when the underground tank is being filled. The manway cover 18 contains two removable fill lids 58 each centered over a fill pipe 54. The overfill containers, 56, 57 each have a gasket 60 around its perimeter to seal the overfill containers 56, 57 to the manway cover 18 and prevent surface water and other liquids from entering the manway 14.

Figure 4:
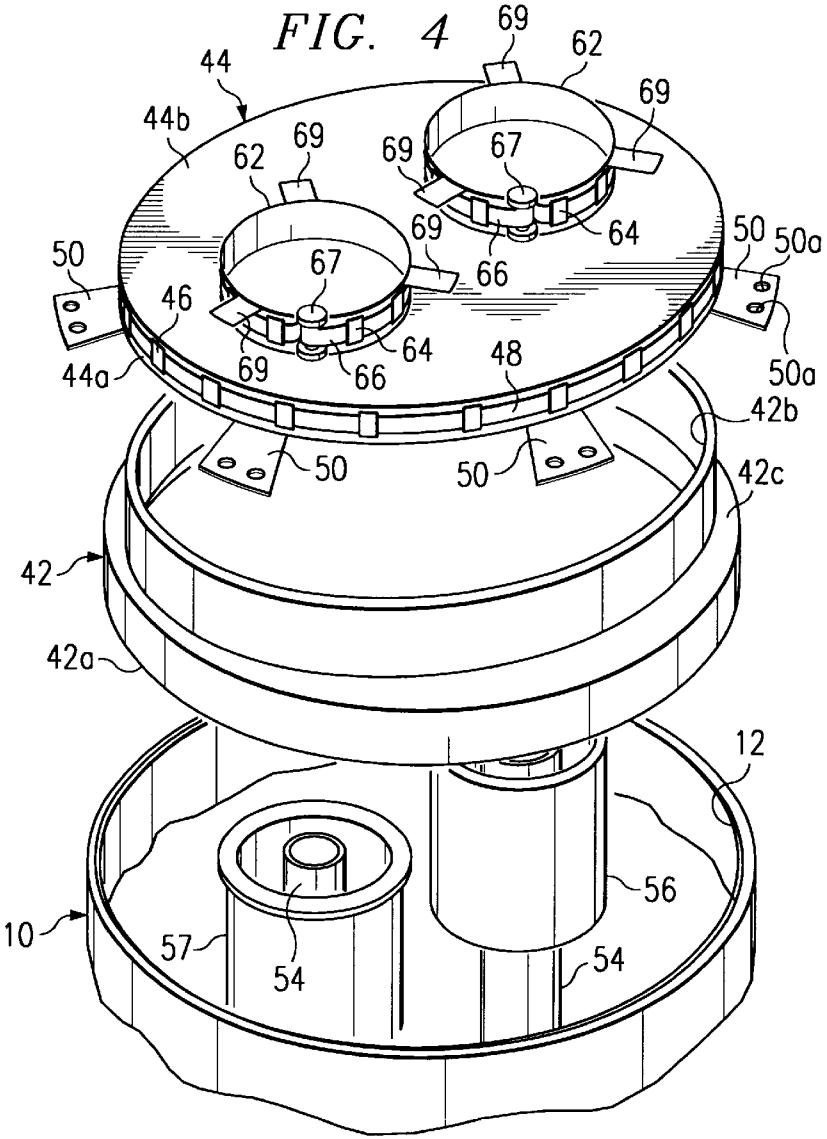
FIG. 4 is an exploded perspective view of the seal and extender embodiment shown in FIG. 3.

Referring to FIGS. 3 and 4, the cover 44 contains two sleeves 62 in the top surface 44*b* to receive the overfill containers 56, 57 and fill pipes 54. Each sleeve 62 is, similar to the cover perimeter 44*a*, equipped with belt loops 64 around its circumference and with a cinch 66 threaded through the belt loops 64. Each cinch 66 may be secured by a rachet buckle 67, or by any other conventional method, to secure the sleeve 62 to its respective overfill container 56, 57. Handles 69 may be placed on the sleeve 62 to assist with installation and removal.

In operation, after the cover perimeter 44*a* is secured to the extender second end 42*b*, each sleeve 62 is similarly secured to an overfill container 56, 57 by a cinch 66. Generally the sleeve 62 is secured above the cover top surface 44*b* to prevent water that accumulates on the cover top surface 44*b* from entering the sump 10. The cover 44 may be easily removed by loosening the cinches 48 and 66, grasping the handles and lifting the cover.

Figure 5:
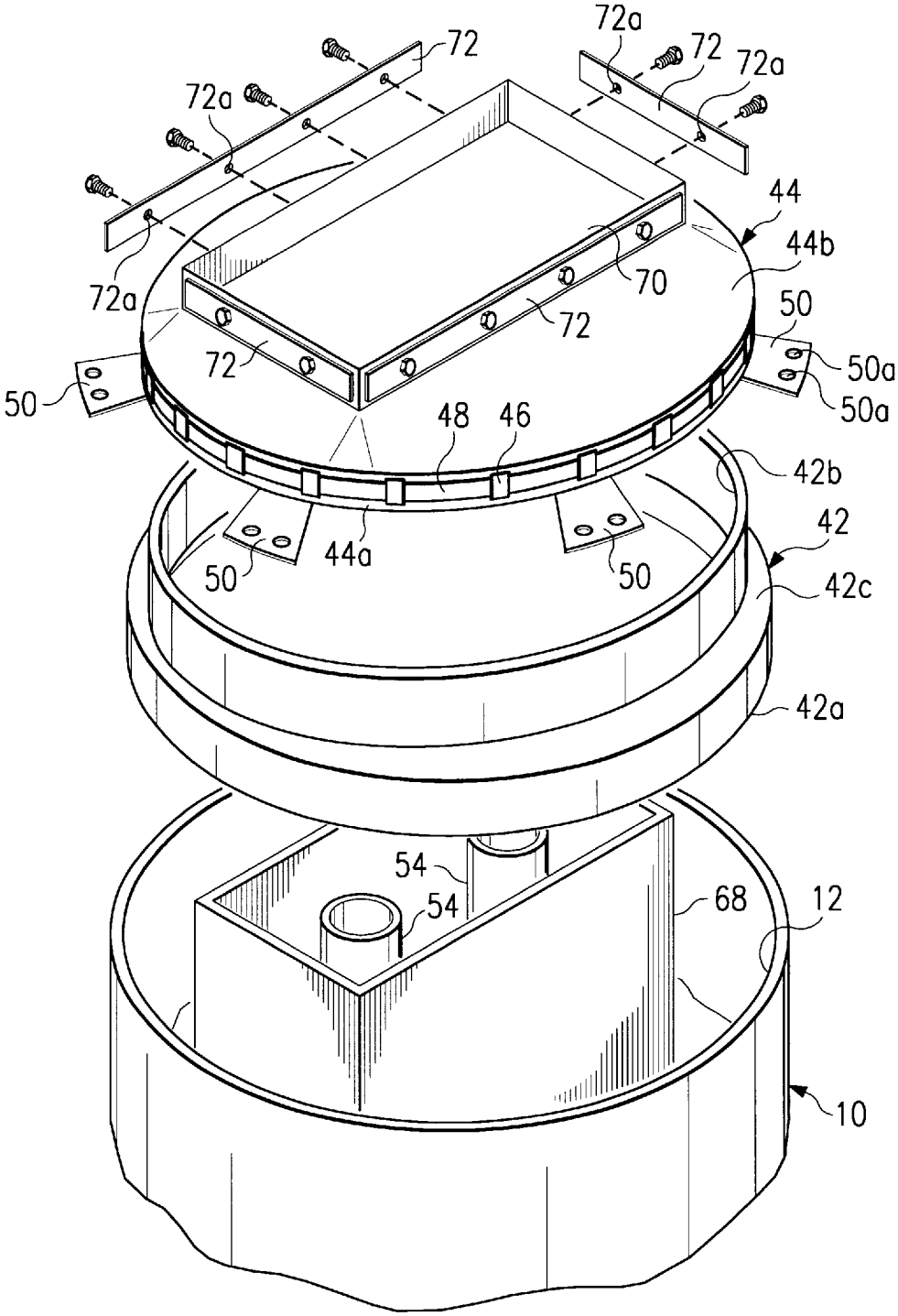
FIG. 5 is an exploded perspective view of another embodiment of the seal and extender embodiment of the present invention.

Referring to FIG. 5, another alternative embodiment of the present invention is shown. This embodiment is designed to be fitted over a sump 10 which contains a square overfill box 68, designed for use similarly to the overfill containers 56, 57 described in connection with FIGS. 3 and 4. In this embodiment the cover 44 contains a substantially square aperture 70. Four plates 72 (only one is shown) are secured to the top 44*b* of the cover 44, one on each side of the aperture 68. Each plate 72 contains holes 72*a* for securing the cover 44 to the overfill box 68 in any conventional fashion. In this embodiment the extender second end 42*b* may be configured in an oblong fashion to receive the overfill box 68.

In operation, after the cover perimeter 44*a* is secured to the extender second end 42*b*, the plates 72 are secured to the overfill box 68 through the holes 72*a* by screws or any other conventional fashion.

The present invention has several advantages. For example, since the first end 42*a* of the extender 42 fits inside the access port 12, the extender 42 may be placed on the sump 10 even when the access port 12 abuts the wall of the manway 14 or when the backfill 22 cannot be removed from around the access port 12. Also, the shoulder 42*c* of the extender 42 defines a channel to allow water to flow around the extender to the backfill 22. With a diameter of the extender second end 42*b* smaller than a diameter of the first end 42*a*, even when the access port 12 abuts the manway 14, the extender 42 can be oriented to allow for the cover 44 to be placed over the second end 42*b*. Another advantage is that the extender 42 and cover 44 may be placed on existing sumps 10.

It is understood that several variations may be made in the foregoing without departing from the scope of the invention. For example, the extender first end 42*a* may be tapered to allow for it to be cut in the field to fit varying diameter access ports 10. In certain installations, it may not be necessary to add the extender 42 and a cover 44 could be placed directly over the access port 12. In other installation, it may not be necessary to use the cover 44. The cover top surface 44*b* may be constructed from non-expandable polyurethane, while the perimeter surface 44*a* may be constructed of an expandable material. Additionally, foam or other material may be affixed to the perimeter surface 44*a* of the cover 44 to provide for a pressure fit to counteract the weight of the top surface 44*b* and any water that may accumulate thereon. The belt loops 46 and 64 and cinches 48 and 66 need not be present as long as the cover 44 may be secured to the access port 12 and overfill containers 56, 57. For example, the perimeter 44*a* of the cover 44 and the sleeves 62 may be constructed of expandable material to provide a compression fit over the access port 12 and overfill containers 56, 57.

Further, it is understood that of the present invention is not limited to the hydrocarbon storage field environment discussed above but rather can be used in other applications requiring that surface water and other liquids not inadvertently enter the sump 10.

Although illustrative embodiments of the invention have been shown and described, a wide range of modification, change, and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed is:

1. A seal for a sump having an access port, the seal comprising:

a cover having a top surface and a perimeter surface, wherein the top surface is capable of covering the access port and the perimeter surface is capable of being secured to the sump adjacent the access port; and at least one belt loop attached to the perimeter surface, a cinch threaded through at least one belt loop around the perimeter surface and a tightening mechanism for tightening the cinch around the perimeter surface to secure the perimeter surface to the sump.

2. The seal of claim 1 wherein the tightening mechanism comprises a rachet buckle.

3. A seal for a sump having an access port, the seal comprising:

a cover having a top surface and a perimeter surface, wherein the top surface is capable of covering the access port and the perimeter surface is capable of being secured to the sump adjacent the access port;

at least one sleeve through the cover for receiving an overfill container; and at least one belt loop attached to the perimeter surface of the cover.

4. The seal of claim 3 further comprising at least one handle secured to the sleeve for assisting with the installation and removal of the sleeve from the overfill container.

5. The seal of claim 3 further comprising at least one vent secured to the top surface of the cover to provide ventilation for the sump.

6. The seal of claim 5 wherein the at least one vent is raised from the top surface to prevent liquid accumulating on the top surface from entering the vent.

7. The seal of claim 3 wherein the perimeter of the cover is comprised of expandable material for creating a pressure fit to the sump.

8. A seal assembly for an underground fiberglass sump accessible through a manway, the sump having an access port adjacent the manway and at least one fill pipe with an overfill container secured thereto extending through the access port into the manway, the seal assembly comprising:

a tubular extender having a first end and a second end, the first end having a diameter larger than a diameter of the second end, the first end capable of being secured to the sump adjacent the access port;

a cover having a first set of belt loops proximate the perimeter of the cover, a first cinch threaded through the first set of belt loops and a first tightening mechanism secured to the belt for securing the cover to the second end of the extender, the cover further comprising:

at least one handle secured to the perimeter of the cover;

a vent secured to a top surface of the cover; and at least one sleeve through the cover for receiving the overfill container, the sleeve having a second set of belt loops around a perimeter of the sleeve, a second cinch threaded through the second set of belt loops and a second tightening mechanism secured to the second belt for securing the sleeve to the overfill container, and a second at least one handle secured to the perimeter of the sleeve, wherein the extender and cover restrict surface water from entering the sump through the manway.

9. A seal for a sump having an access port, the seal comprising:

a cover having a top surface and a perimeter surface, wherein the top surface is capable of covering the access port and the perimeter surface is capable of being secured to the sump adjacent the access port;

at least one sleeve through the cover for receiving an overfill container; and at least one belt loop attached to the sleeve, a cinch threaded through the at least one belt loop around the sleeve and a tightening mechanism for tightening the cinch around the sleeve to secure the sleeve to the overfill container.

10. The seal of claim 9 wherein the tightening mechanism comprises a rachet buckle.

11. A seal for a sump having an access port, the seal comprising:

a cover having a top surface and a perimeter surface, wherein the top surface is capable of covering the access port and the perimeter surface is capable of being secured to the sump adjacent the access port;

at least one sleeve through the cover for receiving at least one fill pipe extending through the access port; and at least one belt loop attached to the perimeter surface of the cover.

12. A seal for a sump having an access port, the seal comprising a cover having a top surface and a perimeter surface, wherein the top surface is capable of covering the access port and the perimeter surface is capable of being secured to the sump adjacent the access port, wherein the cover defines an aperture therein for receiving at least one overfill container and at least one plate secured to the cover adjacent the aperture for securing the cover to the at least one overfill container.

13. The seal of claim 12 wherein the at least one overfill container is a box, the aperture being a square with a plate secured adjacent to each side of the aperture.

14. The seal of claim 13 wherein the plates are secured to each side of the aperture by screws.

15. A seal assembly for a sump having an access port, the seal assembly comprising:

an extender defining a channel, the extender having a first end and a second end, the first end having a diameter larger than a diameter of the second end, the first end capable of being secured to an inner wall of the sump adjacent the access port; and a cover having a top surface and a perimeter surface, wherein the top surface is capable of covering the access port and the perimeter surface secures to the second end of the extender, wherein the top surface of the cover is comprised of a non-expandable material.

16. A seal for a sump having an access port, the seal comprising:

a cover having a top surface and a perimeter surface, wherein the top surface is capable of covering the access port and the perimeter surface is capable of being secured to the sump adjacent the access port and wherein the surface of the cover is comprised of a non-expandable material; and at least one sleeve through the cover for receiving an overfill container.

17. A seal assembly for a sump having an access port, the seal assembly comprising:

an extender defining a channel, the extender having a first end and a second end, the first end having a diameter larger than a diameter of the second end, the first end capable of being secured to the sump adjacent the access port;

a cover having a top surface and a perimeter surface, wherein the top surface is capable of covering the access port and the perimeter surface secures to the second end of the extender; and at least one belt loop attached to the perimeter surface.

18. The seal assembly of claim 17 further comprising at least one vent secured to the top surface of the cover to provide ventilation for the sump through the channel.

19. The seal assembly of claim 18 wherein the at least one vent is raised from the top surface to prevent liquid accumulating on the top surface from entering the vent.

20. The seal assembly of claim 17 further comprising at least one sleeve through the cover for receiving an overfill container secured to at least one fill pipe.

21. The seal assembly of claim 20 further comprising at least one handle secured to the sleeve for assisting with the installation and removal of the sleeve from the overfill container.

22. The seal assembly of claim wherein the perimeter surface of the cover is comprised of expandable material for creating a pressure fit to the extender.

23. The seal assembly of claim 17 further comprising a shoulder between the first end and the second end to channel liquids around the extender.

24. A seal assembly for a sump having an access port, the seal assembly comprising:

an extender defining a channel, the extender having a first end and a second end, the first end having a diameter larger than a diameter of the second end, the first end capable of being secured to an inner wall of the sump adjacent the access port;

a cover having a top surface and a perimeter surface, wherein the top surface is capable of covering the access port and the perimeter surface secures to the second end of the extender; and at least one belt loop attached to the perimeter surface of the cover, a cinch threaded through the at least one belt loop around the perimeter surface and a tightening mechanism for tightening the cinch around the perimeter surface to secure the perimeter surface to the second end of the extender.

25. The seal assembly of claim 24 wherein the tightening mechanism comprises a rachet buckle.

26. A seal assembly for a sump having an access port, the seal assembly comprising:

an extender defining a channel, the extender having a first end and a second end, the first end having a diameter larger than a diameter of the second end, the first end capable of being secured to an inner wall of the sump adjacent the access port;

a cover having a top surface and a perimeter surface, wherein the top surface is capable of covering the access port and the perimeter surface secures to the second end of the extender; and at least one handle secured to the perimeter surface of the cover for assisting with the installation and removal of the cover from the extender.

27. A seal assembly for a sump having an access port, the seal assembly comprising:

an extender defining a channel, the extender having a first end and a second end, the first end having a diameter larger than a diameter of the second end, the first end capable of being secured to an inner wall of the sump adjacent the access port;

a cover having a top surface and a perimeter surface, wherein the top surface is capable of covering the access port and the perimeter surface secures to the second end of the extender; and at least one belt loop attached (to the sleeve), a cinch threaded through the at least one belt loop around the sleeve and a tightening mechanism for tightening the cinch around the sleeve to secure the sleeve to the overfill container.

28. The seal assembly of claim 27 wherein the tightening mechanism comprises a rachet buckle.

29. A seal assembly for a sump having an access port, the seal assembly comprising:

an extender defining a channel, the extender having a first end and a second end, the first end having a diameter larger than a diameter of the second end, the first end capable of being secured to an inner wall of the sump adjacent the access port;

a cover having a top surface and a perimeter surface, wherein the top surface is capable of covering the access port and the perimeter surface secures to the second end of the extender; and at least one sleeve through the cover for receiving an overfill container secured to a fill pipe, wherein the cover defines an aperture therein for receiving the at least one overfill container and at least one plate secured to the cover adjacent to the aperture for securing the cover to at least one overfill container positioned proximate the access port.

30. The seal assembly of claim 29 wherein the at least one overfill container is a box, the aperture being a square with a plate secured adjacent to each side of the aperture.

31. The seal assembly of claim 30 wherein the plates are secured to each side of the aperture by screws.

* * * * *